US007312798B2

(12) United States Patent
Yach et al.

(10) Patent No.: US 7,312,798 B2
(45) Date of Patent: Dec. 25, 2007

(54) DEVICE AND METHOD FOR CONTROLLING THE DISPLAY OF ELECTRONIC INFORMATION

(75) Inventors: David P. Yach, Waterloo (CA); Julian Paas, Mississauga (CA); Ronald Scotte Zinn, Waterloo (CA)

(73) Assignee: Research in Motion Limited, Waterloo, Ontario (CA)

( * ) Notice: Subject to any disclaimer, the term of this patent is extended or adjusted under 35 U.S.C. 154(b) by 25 days.

(21) Appl. No.: 11/038,246

(22) Filed: Jan. 21, 2005

(65) Prior Publication Data

US 2006/0164436 A1 Jul. 27, 2006

(51) Int. Cl.
*G09G 5/02* (2006.01)
*G09G 5/00* (2006.01)

(52) U.S. Cl. ..... 345/589; 345/660; 345/661

(58) Field of Classification Search ..... 345/629, 345/660–661, 589

See application file for complete search history.

(56) References Cited

U.S. PATENT DOCUMENTS

| | | | | |
|---|---|---|---|---|
| 5,185,808 | A | 2/1993 | Cok | |
| 5,265,202 | A | 11/1993 | Kreuger et al. | |
| 5,651,107 | A | 7/1997 | Frank et al. | |
| 5,896,131 | A | 4/1999 | Alexander | |
| 6,118,427 | A * | 9/2000 | Buxton et al. | 345/629 |
| 6,587,118 | B1 * | 7/2003 | Yoneda | 345/629 |
| 6,661,438 | B1 * | 12/2003 | Shiraishi et al. | 715/835 |
| 6,920,606 | B1 * | 7/2005 | Jablonski et al. | 715/501.1 |
| 6,990,638 | B2 * | 1/2006 | Barksdale et al. | 715/853 |
| 7,088,375 | B1 * | 8/2006 | Hamburg | 345/629 |
| 2004/0095358 | A1 | 5/2004 | Takagi et al. | |
| 2004/0169664 | A1 * | 9/2004 | Hoffman et al. | 345/629 |
| 2005/0057576 | A1 * | 3/2005 | Shen et al. | 345/619 |

FOREIGN PATENT DOCUMENTS

| | | |
|---|---|---|
| EP | 344082 | 11/1989 |
| EP | 1182639 A2 | 2/2002 |
| JP | 11219242 | 8/1999 |
| JP | 2003008694 | 1/2003 |
| WO | WO 2005/022501 A1 | 3/2005 |

OTHER PUBLICATIONS

"Optimizing Content for Nokia UIS and Developer Platforms", version 1.0, Mar. 22, 2004.

* cited by examiner

*Primary Examiner*—Jin-Cheng Wang
(74) *Attorney, Agent, or Firm*—Perry + Currier

(57) ABSTRACT

The present invention provides a novel device and method for controlling the display of electronic information. The device can be based on the computing environment of an enhanced personal digital assistant with cellular telephone and electronic message capabilities. The device is operable to present, on its display, user customizable information, such as wallpaper, in conjunction with non-customizable information, such as icons. The device is also operable to perform a transformation such that the user customizable information and non-customizable information are more legible than if no transformation had occurred.

1 Claim, 12 Drawing Sheets

DEVICE AND METHOD FOR CONTROLLING THE DISPLAY OF ELECTRONIC INFORMATION

FIELD OF THE INVENTION

The present invention relates generally to electronic devices and more particularly to an device and method for controlling the display of electronic information.

BACKGROUND OF THE INVENTION

Enhanced electronic devices (EEDs) capable of computing, information storage and communications are increasingly becoming commonplace. EEDs typically integrate the functions of personal information management such as calendaring, data communications such as e-mail and world wide web browsing and telecommunications into a single device. Research In Motion Limited of Waterloo, Ontario, Canada, and PalmOne, Inc. of Milpitas, Calif. USA are two examples of manufacturers of such enhanced wireless electronic devices, and each offer a variety of products in this category.

A typical EED contains a visual display unit, for example a color liquid crystal display (LCD) screen, to visually present information to a user. Indeed, as part of its functionality, an EED is called upon to display a wide variety of rich content. Such content ranges from non-customizable information such as menus, icons, and application dialog boxes, to user customizable information such as wallpapers and pictures. Moreover, both customizable and non-customizable information can usually take many different forms such as text, images and video.

Because the range of displayed content on an EED is usually presented simultaneously, the display may become difficult to read. For example, if the EED display is presenting dark colored wallpaper, then any dark colored icons displayed with the wallpaper can be unreadable.

To address this problem, the user is left to make adjustments to the device, either choosing a new wallpaper or adjusting the contrast and brightness settings in order to improve readability of the icons. While this can produce readable screens, it limits the choices of wallpaper available to the user. Indeed, generally, a users choices for customizable information is limited given readability problems that can arise when presenting the user customizable information beside non-customizable information

SUMMARY OF THE INVENTION

According to an aspect of the invention, there is provided a method for controlling an output device on an electronic device comprising the steps of receiving a first set of information and then receiving a second set of information. The method further comprises the steps of determining a transformation such that presentation of the first set of information in conjunction with the second set of information is more intelligible to a user than if the transformation was not performed, and then applying the transformation to the information. Next, the transformed information is presented.

The method can comprise the additional steps of receiving an additional set of information. In this case the above mentioned determination step can include a transformation whereby presentation of the sets of information in conjunction is more intelligible to a user than if the transformation was not performed.

The output device can be a display. The first set of information can be user customizable information and the second set of information can be non-customizable information.

The user customizable information can comprise at least one of wallpaper, pictures and animations.

The non-customizable information can comprise at least one of icons, menus, and text.

The user customizable information can be presented on a background layer, the non-customizable information can be presented on a foreground layer, and the transformation can be a mask that is applied between the layers, the mask having characteristics in relation to the non-customizable information such that the non-customizable information is legible when presented with the user customizable information.

The transformation used in performing the method can be a selection of a physical location for presentation of the non-customizable information in relation to the customizable information on the display.

The transformation can also be an adjustment to a histogram associated with at least one of the non-customizable information and the customizable information.

The transformation can also be a selection of an alternative non-customizable information from a default non-customizable information that conveys substantially the same information as the default non-customizable information.

The determining steps of the method can comprise determining a plurality of transformations such that presentation of the first set of information in conjunction with the second set of information is more intelligible to a user than if the transformation was not performed.

Another aspect of the invention provides an enhanced electronic device comprising an output device for presenting content and a storage device for storing a first set of information and a second set of information destined for the output device. The device typically comprises a processing unit connected to the storage device for retrieving the sets of information. The processing unit is operable to determine a transformation to the information whereby presentation of the first set of information in conjunction with the second set of information is more intelligible than if the transformation was not performed. The processing unit is further operable to apply the transformation to the information and forward the transformed information to the output device for presentation.

Another aspect of the invention provides a computer readable media for storing a set of programming instructions for an electronic device. The instructions comprise a method for controlling an output device on an electronic device characterized by several steps. The first step is to receive a first set of information and to receive a second set of information. Another step in the method comprises determining a transformation such that presentation of the first set of information in conjunction with the second set of information is more intelligible to a user than if the transformation was not performed. Another step in the method comprises applying the transformation to the information and presenting the transformed information.

BRIEF DESCRIPTION OF THE DRAWINGS

The invention will now be described by way of example only, and with reference to the accompanying drawings, in which.

DETAILED DESCRIPTION OF THE INVENTION

Figure 1:
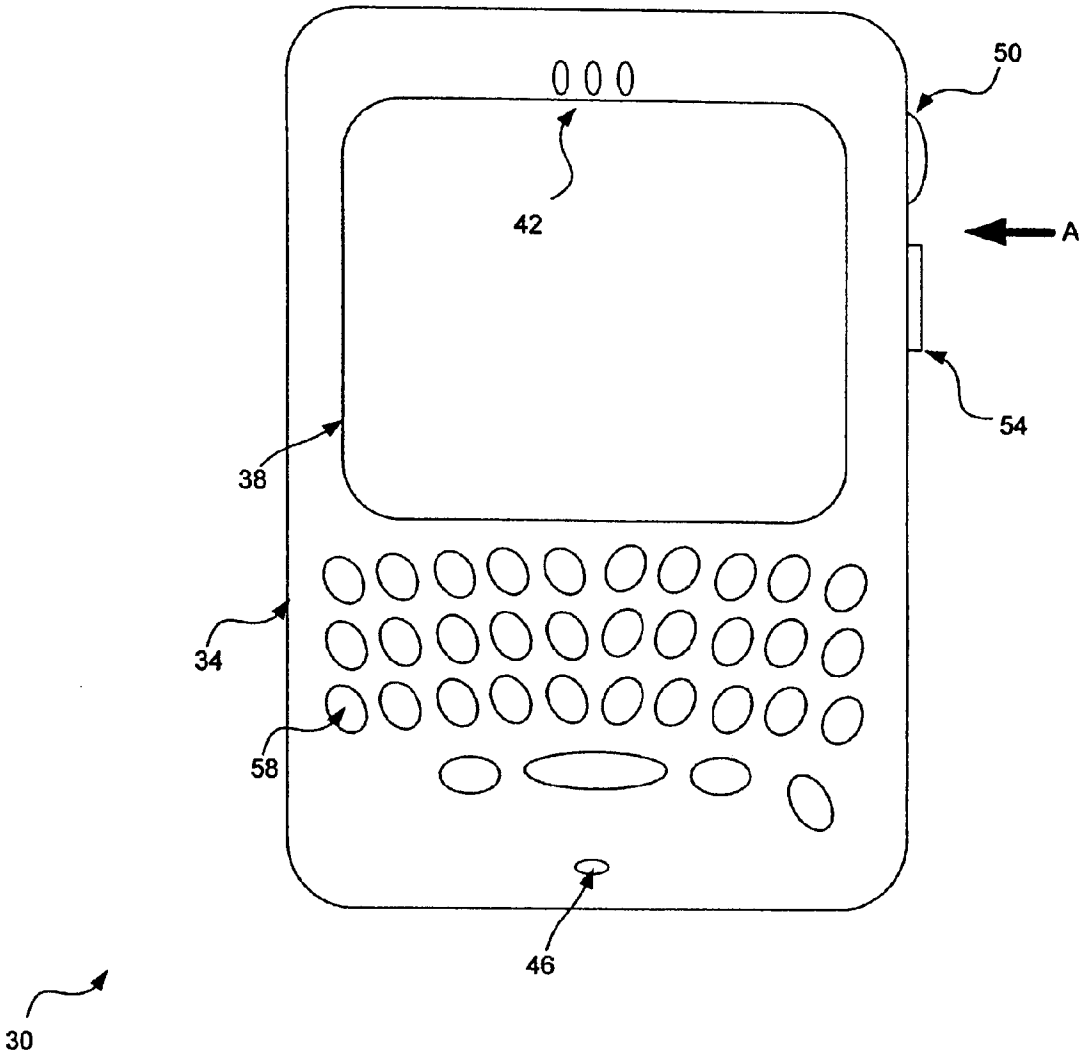
FIG. 1 is a schematic representation of a of an enhanced electronic device in accordance with an embodiment of the invention.

Referring now to FIG. 1, an enhanced electronic device ("EED") in accordance with an embodiment of the invention is indicated generally at 30. In the present embodiment, device 30 is based on the computing environment and functionality of a personal digital assistant with wireless voice telephony capabilities. However, it is to be understood that device 30 can be based on the construction and functionality of any mobile electronic device that can be connected to a wireless network as well. Such devices include cellular telephones or laptops computers connected to wireless networks. In a present embodiment, electronic device 30 includes, a housing 34, which frames an LCD display 38, a speaker 42, a microphone 46, a trackwheel 50, an exit key 54 and a keyboard 58. Trackwheel 50 and exit key 54 can be inwardly depressed along the path of arrow "A" as a means to provide additional user-input. It will be understood that housing 34, can be made from any suitable material as will occur to those of skill in the art.

Figure 2:
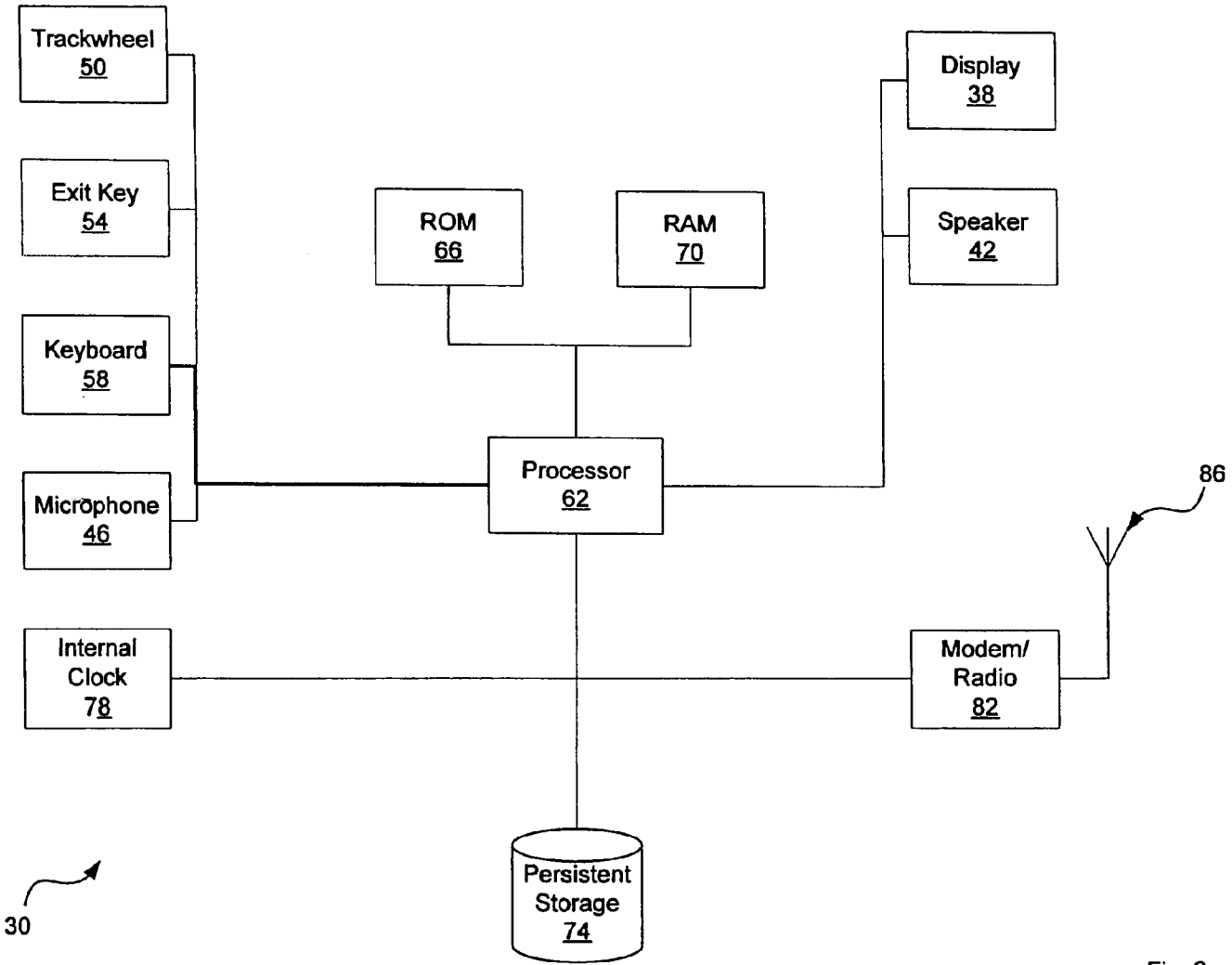
FIG. 2 is a block diagram of certain internal components of the device of FIG. 1.

Referring now to FIG. 2, a block diagram of certain internal components within device 30 are shown. Device 30 is based on a microcomputer that includes a processor 62. Processor 62 is connected to a read-only-memory ("ROM") 66, which contains a plurality of applications executable by processor 62 that enables device 30 to perform certain functions. Processor 62 is also connected to a random access memory unit ("RAM") 70 and a persistent storage device 74 which is responsible for various nonvolatile storage functions of device 30. Processor 62 can send output signals to various output devices including display 38 and speaker 42. Processor 62, can also receive input from various input devices including microphone 46, trackwheel 50, exit key 54 and keyboard 58. Processor 62 is also connected to an internal clock 78 and a modem and radio 82. Modem and radio 82 are operable to connect device 30 to one or more wireless base stations in range of device 30, in the usual manner, via an antenna 86.

In a present embodiment display 38 is operable to present content consisting of both user customizable information such as pictures and wallpapers, and non-customizable information such as menus and application icons. For example, in FIG. 3, display 38 is shown presenting content comprising user customizable information. In the present example, user-customizable information is a wallpaper 90, which is an electronic image. Wallpaper 90 can be received at device 30 in any desired manner such as by transmission to device 30 via wireless modem 82, and storing on persistent storage 74, thereafter becoming available for further access by device 30. When selected for presentation to the user, wallpaper 90 is retrieved from storage 74 by processor 62 and temporarily stored in RAM 70. While in RAM 70, wallpaper 90 is available for rendering by processor 62. Once rendered, wallpaper 90 is then sent to display 38, by processor 62, for presentation to the user. While the user customizable information presented in this example is a specific image, it is to be understood that this is merely exemplary, and that user customizable information can comprise many different forms of information including any image, text or video, or combinations thereof, and that all of these variations are within the scope of the invention. It is also to be understood that such user customizable information can be loaded into device 30 via any appropriate input/output device associated with device 30.

Figure 4:
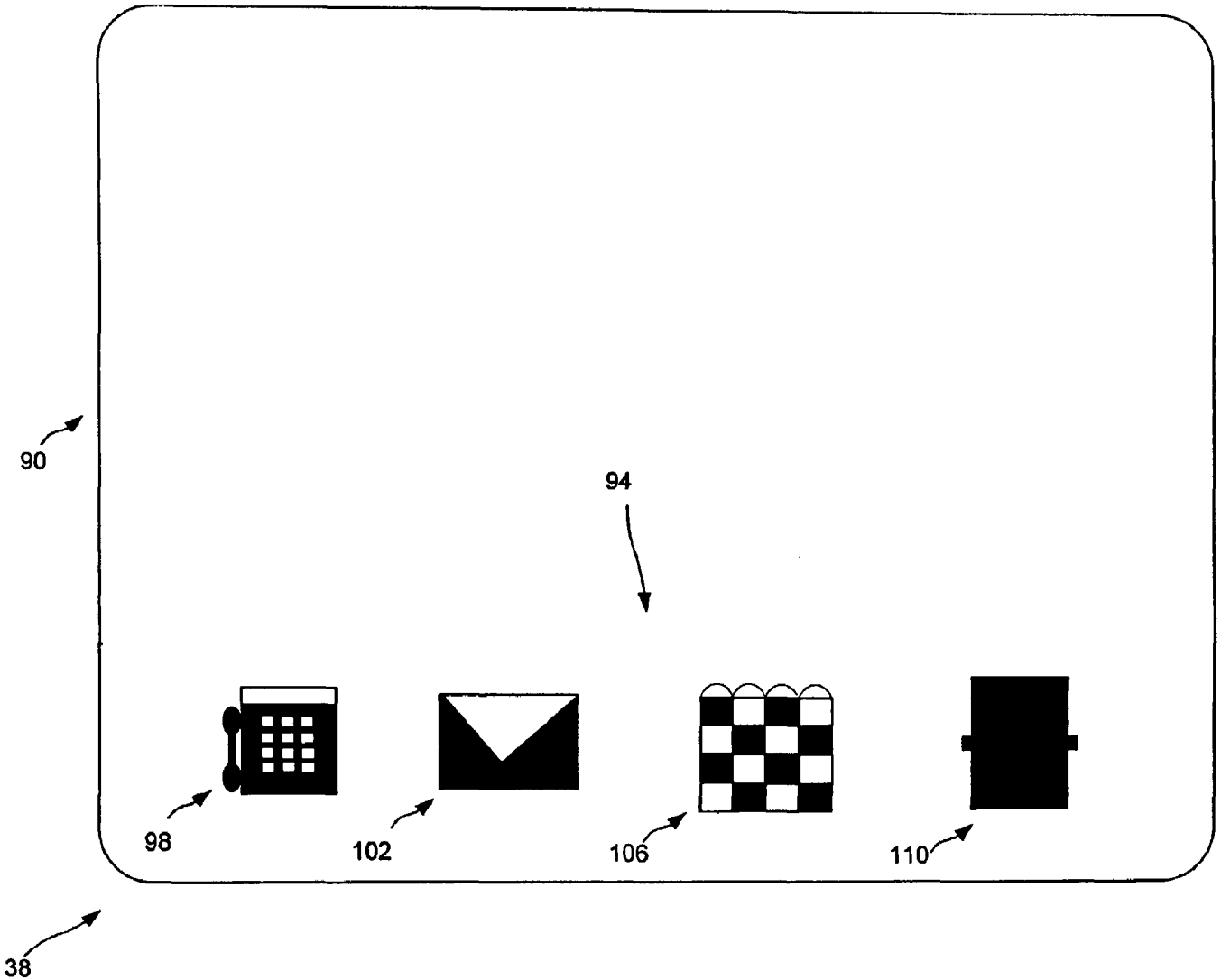
FIG. 4 is a representation of certain information being presented on the display of FIG. 1.

FIG. 4 depicts another example of content presentation on display 38. In FIG. 4 presented content is non-customizable information comprising a plurality of application icons 94 that can be selected to execute an associated application on device 30. More particularly, in a present embodiment, icons 94 includes an icon 98 for a telephone application, an icon 102 messaging application (e.g. email and/or short message service), an icon 106 for a calendar application and an icon 110 for an address book application 114. The telephone application associated with icon 98 allows a user of device 30 to conduct a voice telephone call. The email messaging application associated with icon 102 allows a user to send and receive email messages. The calendar application associated with icon 106 allows a user to manage calendar appointments. The address book application associated icon 110 allows a user to manage contact information. While a specific set of applications are shown on main screen 90, it is to be understood that such applications are exemplary and different combinations and/or types of offerings of applications can be shown, as desired, according to the features and applications associated with device 30.

In the present example, icons 94 reside in ROM 66. When selected for presentation to the user, icons 94 are retrieved from ROM 66 by processor 62 and temporarily stored in RAM 70. While in RAM 70, icons 94 are available for rendering by processor 62. Once rendered, icons 94 are then sent to sent to display 38, by processor 62, for presentation to the user.

As will be explained in greater detail below, device 30 is operable to perform a transformation such that when wallpaper 90 and icons 94 are presented together on display 38, icons 94 are more legible than if the transformation had not occurred.

Figure 5:
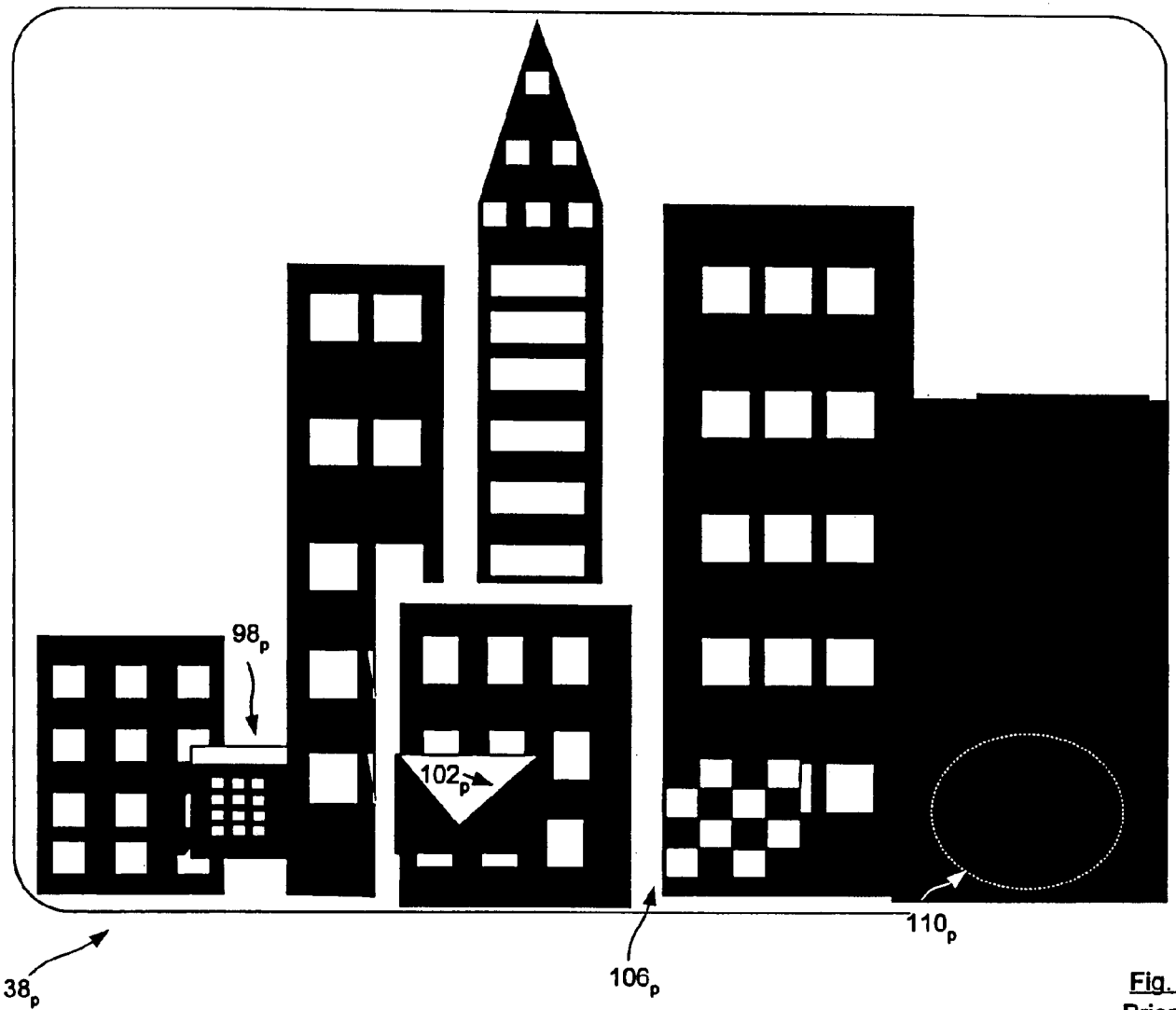
Fig. 5 Prior Art
FIG. 5 is a representation of certain information being presented on the display in accordance with prior art.

Before explaining the present embodiment further, it is useful to briefly discuss the prior art. Referring now to FIG. 5, a prior art device is indicated at $\mathbf{30}_p$. Device $\mathbf{30}_p$ includes several of the same components as device 30, and like components are indicated with like reference, but followed by the suffix "p". In contrast to device 30, however, device $\mathbf{30}_p$ is unable to perform a transformation to improve legibility of icons 94. The result, as shown in FIG. 5, is that icons $\mathbf{94}_p$ are illegible, or poorly legible, when presented with wallpaper $\mathbf{90}_p$. More specifically, icons $\mathbf{98}_p$, $\mathbf{102}_p$ and $\mathbf{106}_p$ are barely distinguishable whereas, icon $\mathbf{110}_p$ is completely invisible, obscured by wallpaper $\mathbf{90}_p$. The location of icon $\mathbf{110}_p$ is circled by the dotted while ellipse.

Figure 6:
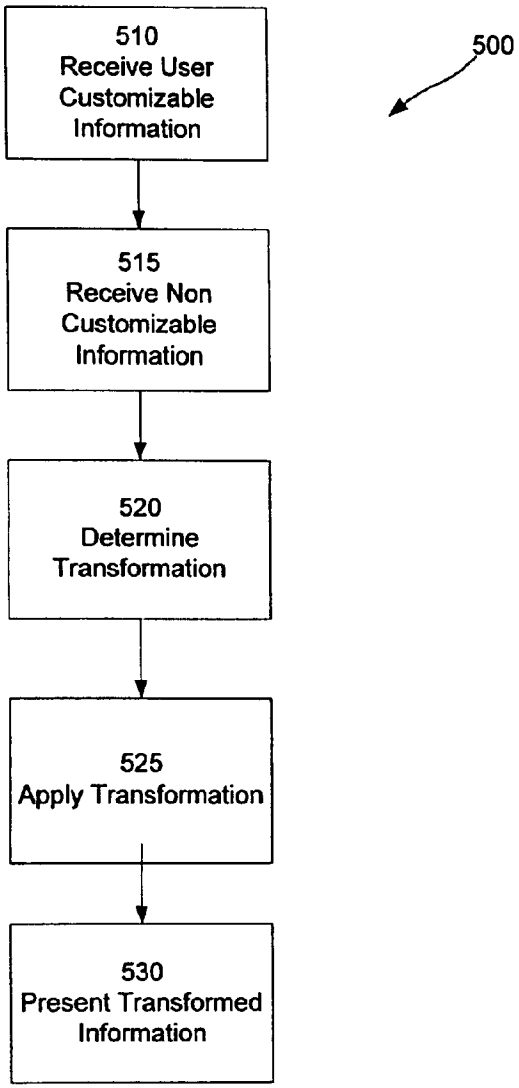
FIG. 6 is a flowchart depicting a method of presenting information in accordance with an embodiment of the invention.

Having explained the prior art, reference will now be made to FIG. 6, which depicts a method for controlling a display in accordance with another embodiment of the invention and is indicated generally at 500. In order to assist in the explanation of the method, it will be assumed that method 500 is operated using device 30. Furthermore, the following discussion of method 500 will lead to further understanding of device 30 and its various components. However, it is to be understood that device 30 and/or method 500 can be varied, and need not work exactly as discussed herein in conjunction with each other, and that such variations are within the scope of the present invention.

Figure 3:
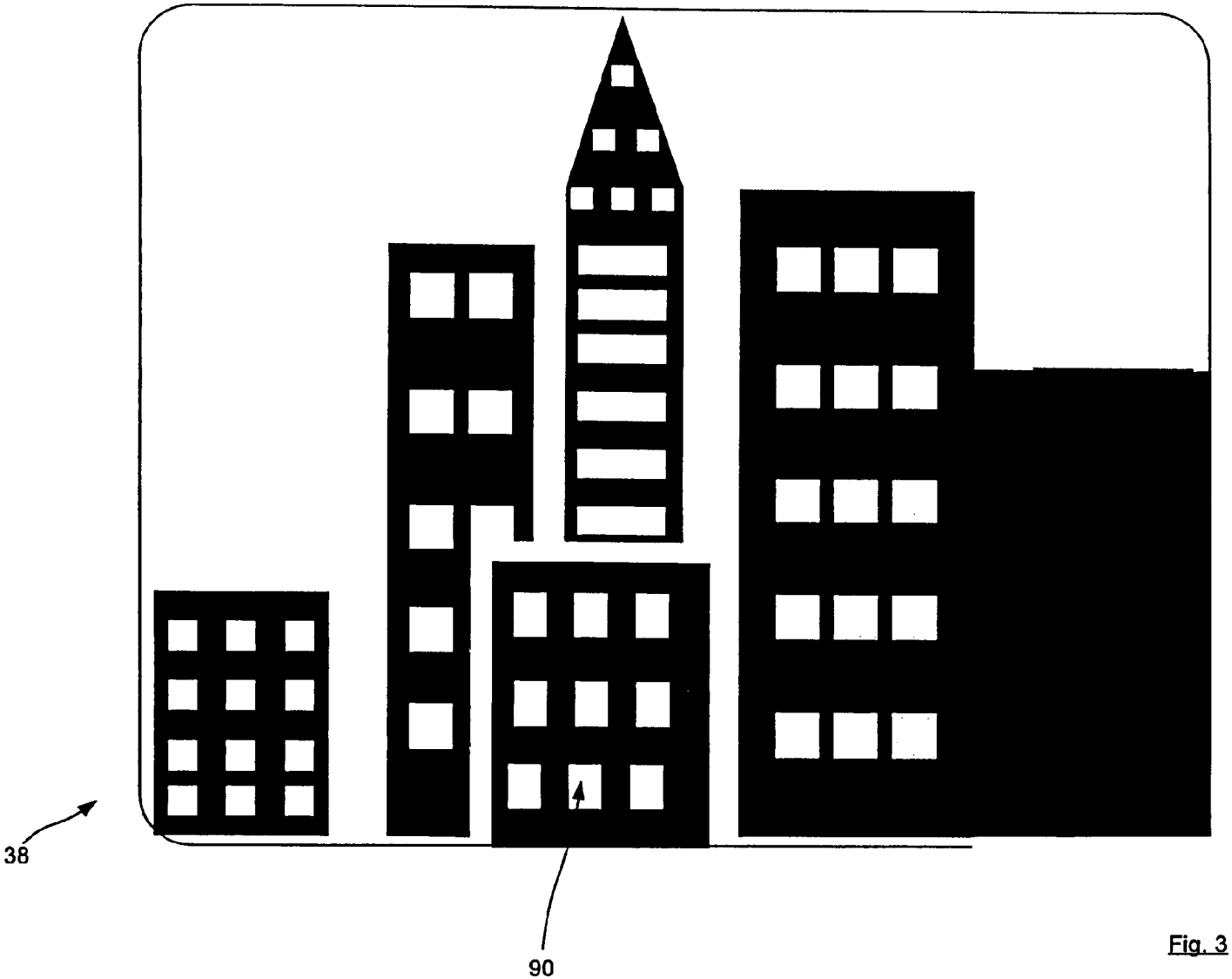
FIG. 3 is a representation of certain information being presented on the display of FIG. 1.

Beginning first at step 510, user customizable information to be presented to the user is received. In a present embodiment, processor 62 receives the user customizable information, which in the present example comprises wallpaper 90, as depicted in FIG. 3, by retrieving wallpaper 90 from persistent storage 74. Once received, wallpaper 90 is then temporarily stored in RAM 70 by processor 62.

Moving to step 515, the non-customizable information to be presented is received. Continuing with the present example, processor 62 receives non-customizable information, which comprises icons 94 as depicted in FIG. 4, by retrieving icons 94 from ROM 66. Once retrieved, icons 94 are temporarily stored in RAM 70 by processor 62.

Figure 7:
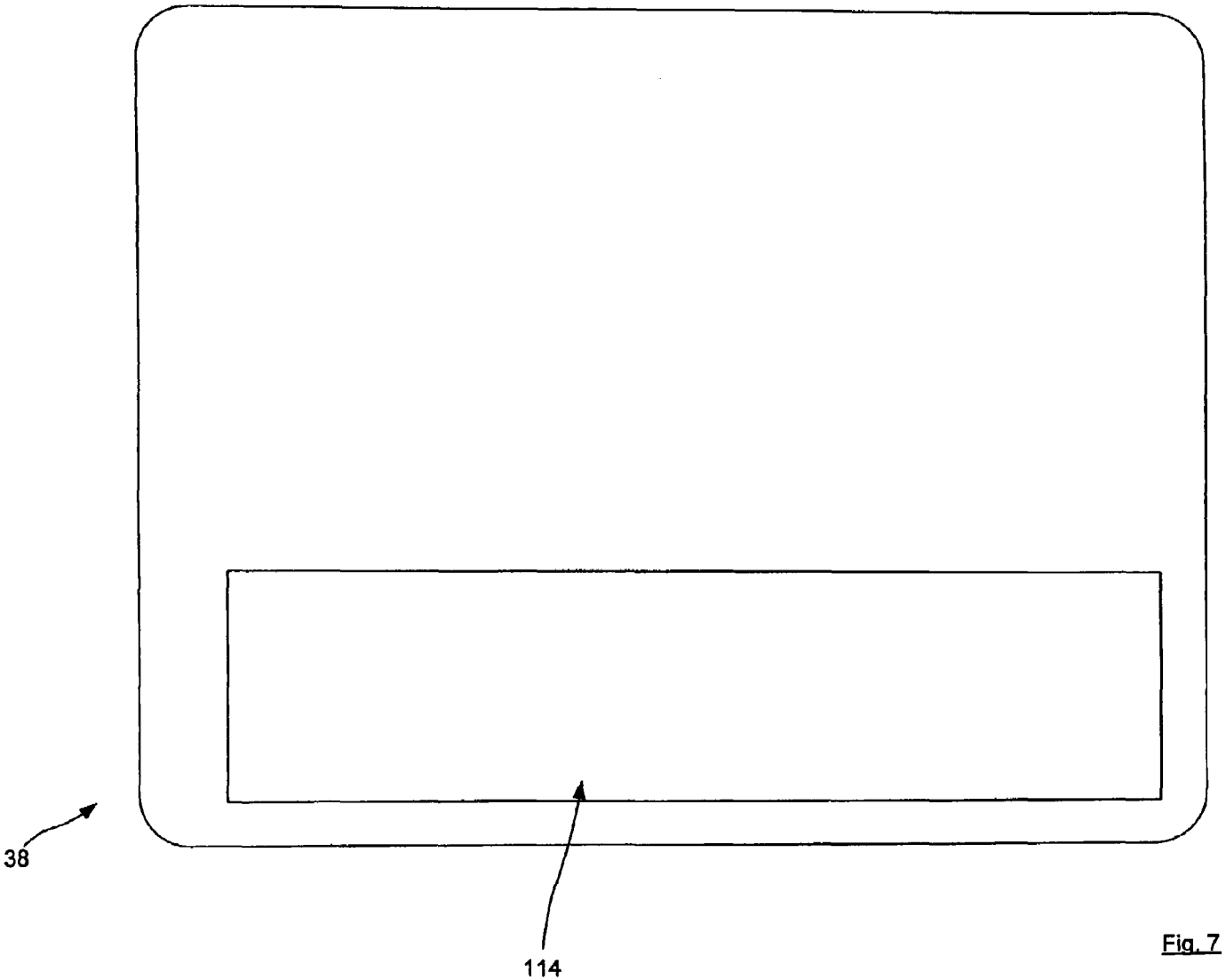
FIG. 7 is a representation of certain information being presented on the display of FIG. 1 during the performance of the method of FIG. 6.

Next, at step 520, a determination is made as to what transformation to apply to make the presented information more legible. In the present example, as shown in FIG. 7, the transformation takes the form of a mask 114. The color of mask 114 is white to provide contrast between icons 94 and mask 114 so as to improve the legibility of icons 94 when wallpaper 90 and icons 94 are presented simultaneously. The location of mask 114 corresponds to where icons 94 are typically displayed.

In FIG. 7, mask 114 is completely opaque—i.e. non-transparent. The non-transparency of mask 114 can be expressed in terms of measuring the transparency of the mask—where zero percent transparency means opaque—nothing behind the mask is visible. In contrast, one-hundred percent transparency means completely transparent—the mask is completely invisible an all information behind the mask is visible. While in the present embodiment mask 114 has a transparency of zero percent, in other embodiments, the level of transparency is not particularly limited and can depend on the particular information being presented. The level of transparency can be from about zero percent to about eighty-percent. More preferably, the level of transparency can be from about one percent to about fifty percent. Still more preferably, the level of transparency can be from about five percent to about fifteen percent. The size of mask 114 is such that mask 114 covers substantially the same area as typically occupied by icons 94.

Figure 8:
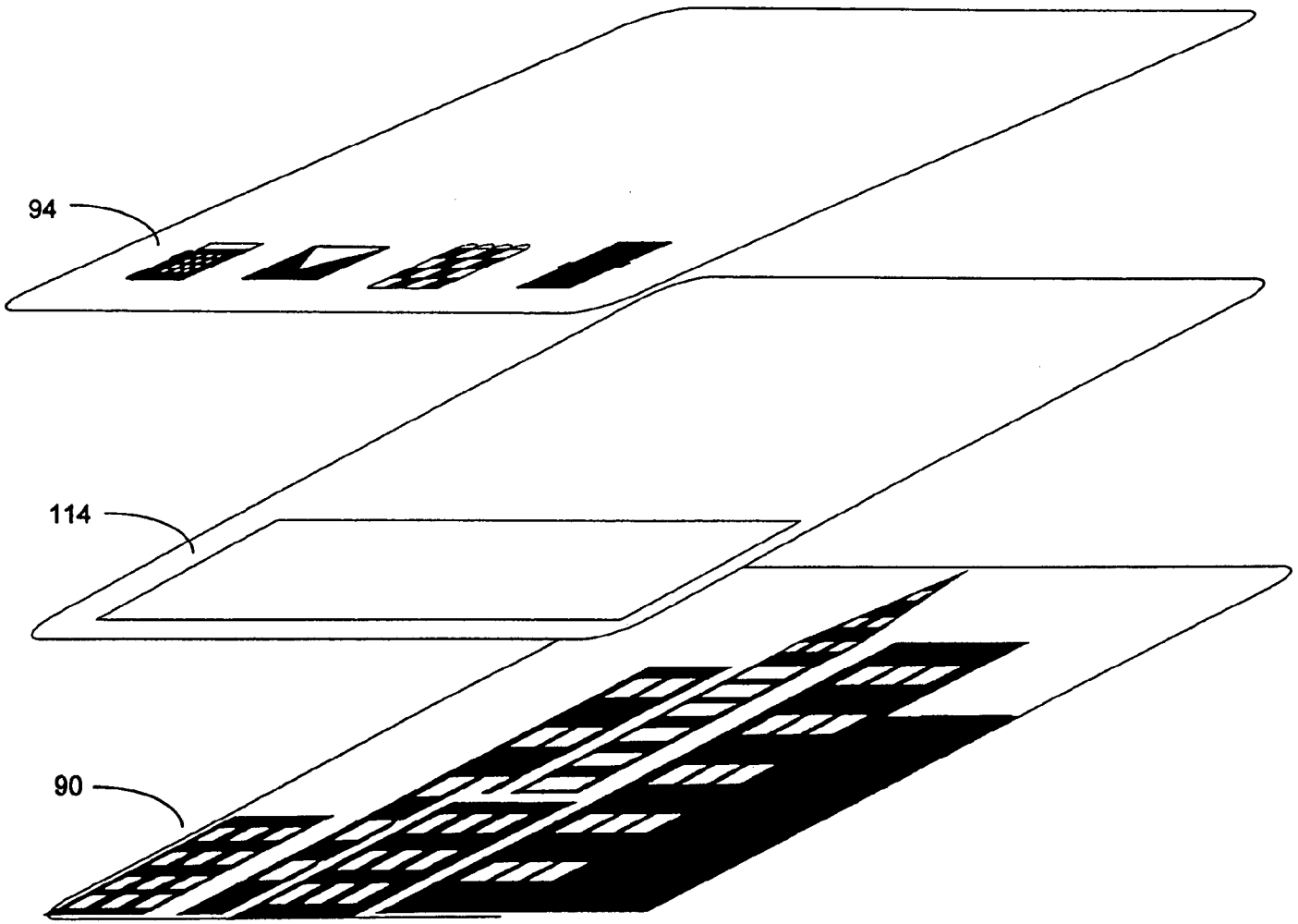
FIG. 8 is a representation of certain of layers being used during the performance of the method of FIG. 6.

Referring again to FIG. 6, at step 525, the transformation determined at step 520 is applied to the information to be presented to improve the legibility of the final presentation. Continuing with the present example, as shown in FIG. 8, mask 114 is applied as a layer between wallpaper 90 and icons 94, where wallpaper 90 is the bottom most layer, mask 114 is the middle layer and icons 94 is the topmost layer. Hence, processor 62 combines wallpaper 90, mask 114, and icons 94 according to the layering arrangement to form an image to be presented to the user.

Figure 9:
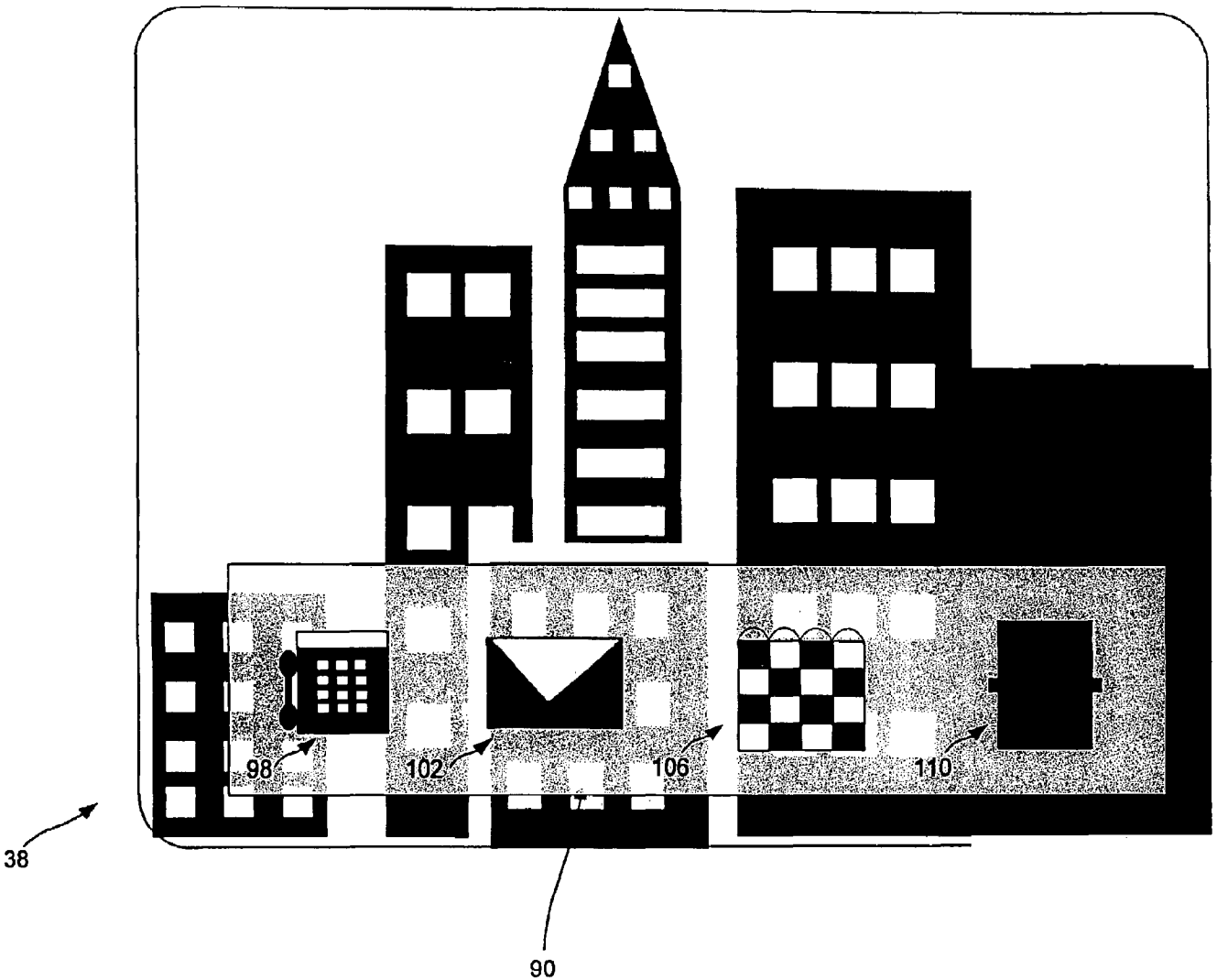
FIG. 9 is a representation of certain information being presented on the display of FIG. 1 during the performance of the method of FIG. 6.

Finally, at step 530, the transformed image is presented to the user. In a present embodiment, as shown in FIG. 9, processor 62, first combines wallpaper 90, mask 114, and icons 94 into a single content, by using portion of the wallpaper outside the mask area in its original form, adding the icons, and then graying, by about 95%, the portion of the wallpaper that is covered by the mask but outside the area occupied by the icons. The resulting image, as shown in FIG. 9, is sent by processor 62, to display 38 for final presentation to the user.

Figure 10:
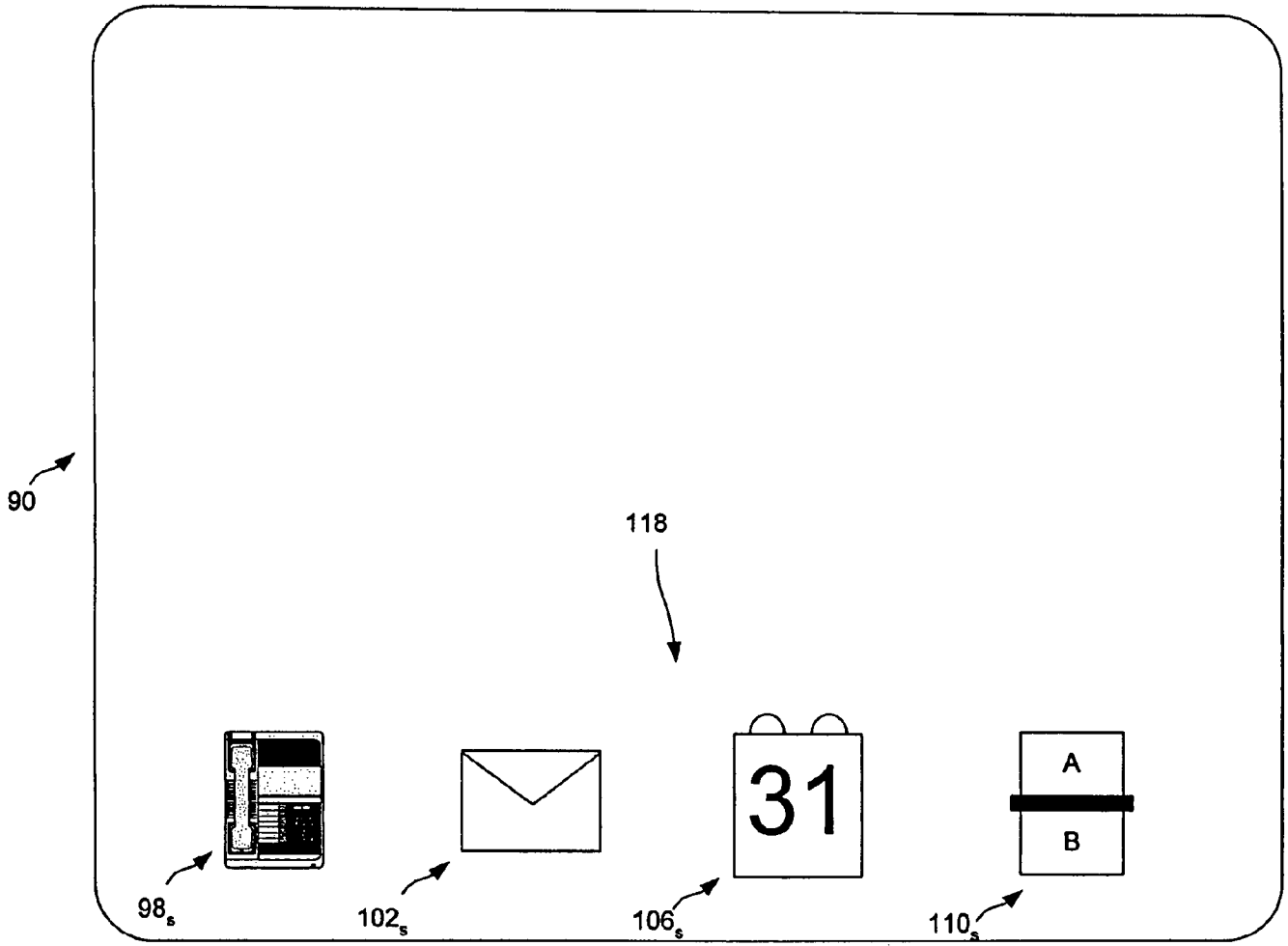
FIG. 10 is a representation of certain information being presented on the display of FIG. 1 during the performance of the method of FIG. 6.

It is to be understood that although in above-described example the transformation in method 500 was carried out using mask 114, in other embodiments the transformation can be effected in different ways. By way of example, a transformation can be performed via the selection of alternative non-customizable information that differ from the default non-customizable information, but yet convey substantially the same information as the default non-customizable information. In the present example, alternative non-customizable information comprises icons $\mathbf{94}_s$, shown in FIG. 10, which are stored in ROM 66, retrievable by processor 62, and comprise a plurality of application icons that can be selected to execute an associated application on device 30. Also in the present example, default non-customizable information comprises icons 94, as shown in FIG. 4. Although the plurality of icons comprising icons $\mathbf{94}_s$ look substantially different than the plurality of icons comprising icons 94, they are functionally substantially the same. Referring now to FIG. 10, alternative icons $\mathbf{94}_s$ are substantially the same as default icons 94; in FIG. 10, like icons $\mathbf{94}_s$ are indicated with like reference, but followed by the suffix "s". More specifically, icons 98 and $\mathbf{98}_s$ are each associated with the previously described telephone application, icons 102 and $\mathbf{102}_s$ are each associated with the previously described messaging application, icons 106 and $\mathbf{106}_s$ are each associated with the previously described calendar application and icons 110 and $\mathbf{110}_s$ are each associated with the previously described address book application 114. Reference will now be made again to method 500 in FIG. 6 to assist in the explanation of the workings of this embodiment based on these assumptions.

Beginning first at step 510, user customizable information to be presented to the user is received. In a present embodiment, processor 62 receives the user customizable information, which in the present example comprises wallpaper 90, as depicted in FIG. 3, by retrieving wallpaper 90 from persistent storage 74. Once received, wallpaper 90 is then temporarily stored in RAM 70 by processor 62.

Moving to step 515, the default non-customizable information is received. Continuing with the present example, processor 62 receives default non-customizable information, which comprises icons 94 as depicted in FIG. 4, by retrieving icons 94 from ROM 66. Once retrieved, icons 94 are temporarily stored in RAM 70 by processor 62.

Next, at step 520, a determination is made as to what transformation to apply to make the presented information more legible. In the present example, processor 62 compares the legibility of the image resulting from combining icons 94 and wallpaper 90, as depicted in FIG. 5 with the legibility of the image resulting from combining icons $\mathbf{94}_s$, with wallpaper 90, shown in FIG. 11. The comparison can be based on suitable or desired criteria, such as an analysis of the level of contrast between icons 94 and wallpaper 90, and the level of contrast between icons $94_s$ and wallpaper 90. The contrast level determination can be carried out by using operations that are generally known to those skilled in the art. Based on these analysis, processor 62 will determine that contrast levels when using icons $94_s$ is improved, and hence icons $94_s$ should be presented to the user as the non-customizable information.

Figure 11:
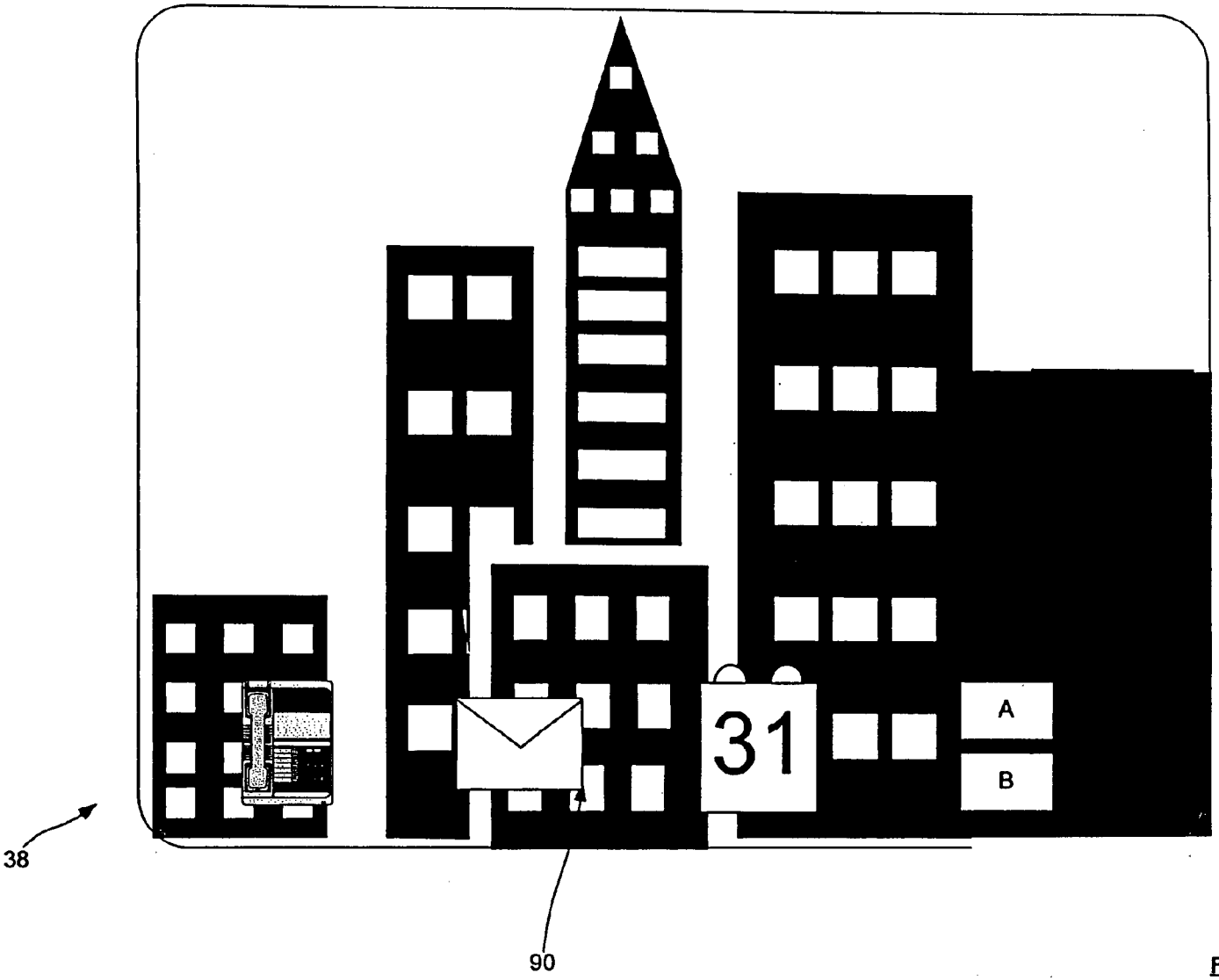
FIG. 11 is a representation of certain information being presented on the display of FIG. 1 during the performance of the method of FIG. 6.

Continuing with method 500, at step 525, the transformation determined at step 520 is applied to the information to be presented to improve the legibility of the final presentation. In the present example, the transformation is a substitution of icons $94_s$ for icons 94. Hence, processor 62 combines wallpaper 90 and icons $94_s$ to form an image to be presented to the user. Finally, at step 530, the resulting image, as shown in FIG. 11, is sent by processor 62, to display 38 for final presentation to the user.

Figure 12:
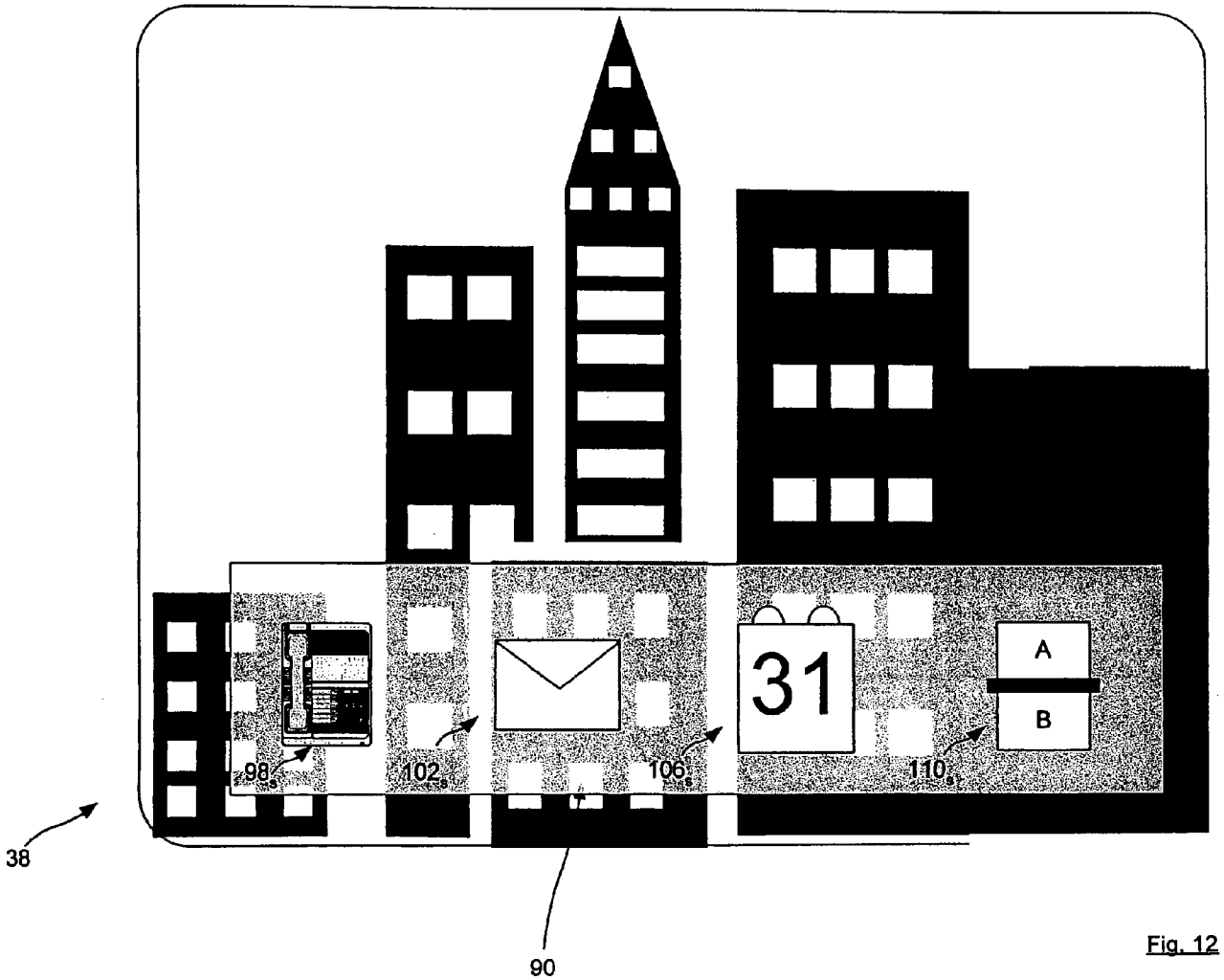
FIG. 12 is a representation of certain information being presented on the display of FIG. 1 during the performance of the method of FIG. 6.

It should now be apparent to those skilled in the art that the transformation operation of method 500 need not be confined to a single operation and that combination of transformations are within the scope of this invention. For example, FIG. 12 shows display 38 presenting an image that initially comprised icons 94 and wallpaper 90, and was transformed to improve legibility using both mask 114, and icons $94_s$ containing both of the above described specific examples.

While only specific combinations of the various features and components of the present invention have been discussed herein, it will be apparent to those of skill in the art that desired subsets of the disclosed features and components and/or alternative combinations of these features and components can be utilized, as desired. In other embodiments, method 500 can be effected in various different ways. For example, method 500 can be performed once for each of icon 98, 102, 106 and 110, rather than performing method 500 once on all four of icons 94 as discussed above.

Moreover, in performing method 500, a number of different types of transformation available to device 30 at the determination at step 520 are contemplated, in addition to the specific examples described above. As one further example, different types of transformations can be applied to the icons (or other non-customizable information), and/or to the wallpaper (or other user customizable information). For example, histograms of either the non-customizable information or the user customizable information can be modified to change contrast, brightness, color and/or other image characteristics to improve legibility. In this manner, sophisticated transformations can be performed on the icons and/or the wallpaper and/or other features of the displayed information to effect an improvement in legibility.

Alternatively, the transformation could be effected by simply moving the location of the information to be presented to the user. For example, icons 94 could be moved to a part of wallpaper 90 where legibility would be improved due to increased contrast between icons 94 and the part of the wallpaper 90 they are now occupying.

One or all of the transformations described herein, or otherwise now apparent to those of skill in the art, can be performed as part of performing method 500 as desired.

Determination of which of the available transformations to apply can be made either automatically by device 30 (which would employ numerous metrics such as contrast to gauge legibility, to make these determinations) or manually by the user who can select desired transformation to fit his or her preferences.

At this point it should be apparent to those skilled in the art that the types of user customizable information, and non-customizable information is not particularly limited. As an example, non-customizable information includes any device output in the form of text, color, images, video, audio and tactile information such as vibration mode in enhanced digital devices, and can include icons, menus, windows, dialog boxes. User customizable information can include any text, color, images animations, audio, and other forms that can be altered by a user including the appearance of non-customizable information such as the appearance of menus and icons as well as display themes. For example, where the user customizable information is an animated image that is presented on display 38, then method 500 can be executed for each frame of the animation (or at such other interval as appropriate) such that when applying the transformation the icons 94 being presented have greater legibility than if the transformation had not been performed. As an additional example, method 500 can be applied to audio signals rather than visual signals. In an electronic device having Motion Picture Experts Group layer three ("MP3") or other audio playback capability, and where that device is configured to present user customized information in the form of playing music (or other audio file), then default audible signals (i.e. non-customizable information in the form of ringing a telephone or chiming an alarm) that occur during the playback of the music, can be transformed to a substitute audible signal so that the substitute audible signal is more readily intelligible to the user than the default audio signal. In yet another example, the transformation could be applied to user-customizable information when a user makes more than one customization. For example, if a user picks a wallpaper and alters the appearance of icons according to a theme, a transformation can be applied to improve the legibility of the icons when combined with the chosen wallpaper.

As a still further variation, device 30 can be configured so that the performance of method 500 can be disabled by a selection from the user, in the event that the user does not wish make use of method 500 but prefers to manually adjust device 30 for desired levels of contrast.

It should now be apparent to those skilled in the art that step 520 and step 525 was performed out by processor 62 one or both these step could have also been performed by an intelligent display, a graphics card, or some other dedicated processor operable to perform transformations. More generally, it should be understood that device 30 is merely one computing environment on which method 500 (or its variants) can be performed, and other types of computing environments can include cellular telephones, personal digital assistants, desktop computers, client-terminals accessing servers, etc.

The present invention provides a novel electronic device that is operable to present both user customizable information and non-customizable information by applying a transformation thereto such that when the information is presented it is more legible than if the information was presented without performing the transformation. In this manner, the device is easier to use, allowing greater flexibility for the user and encouraging the user to make use of customizable and/or personalization features of the device, without hampering the user's ability to use the device features.

The above-described embodiments of the invention are intended to be examples of the present invention and alterations and modifications may be effected thereto, by those of skill in the art, without departing from the scope of the invention which is defined solely by the claims appended hereto.

The invention claimed is:

1. A method for controlling a display device on a mobile electronic device; said method comprising the steps of:

receiving wallpaper for presentation on a background layer of said display device;

receiving a first set of icons for presentation on a foreground layer above at least a portion of said wallpaper that results in a first level of contrast between said wallpaper and said icons, said first level of contrast resulting in said icons obscuring said wallpaper;

selecting an alternative set of icons from at least one additional set of alternative icons that conveys substantially the same information as said first set of icons; said alternative set of icons selected to provide a second level of contrast between said wallpaper and said alternative set of icons; said second level of contrast being greater than said first level of contrast; and, presenting, on said display device, said wallpaper on said background layer, and said alternative set of icons above said wallpaper on said foreground layer such that said alternative set of icons is distinguished from said wallpaper.

* * * * *